United States Patent [19]

Gueringer et al.

[11] Patent Number: 5,050,929

[45] Date of Patent: Sep. 24, 1991

[54] AUXILIARY FURNITURE TRAY SYSTEM

[76] Inventors: John M. Gueringer, 1124 Firestone Ln., North Little Rock, Ark. 72118; Paul A. Reesnes, 212 Howell Mountain Rd., Rose Bud, Ark. 72137

[21] Appl. No.: 632,156

[22] Filed: Dec. 21, 1990

Related U.S. Application Data

[63] Continuation-in-part of Ser. No. 426,014, Oct. 24, 1989, abandoned.

[51] Int. Cl.[5] ..... A47C 7/70

[52] U.S. Cl. ..... 297/145; 297/149

[58] Field of Search ..... 297/145, 162, 194, 149, 297/161, 155; 5/507

[56] References Cited

U.S. PATENT DOCUMENTS

| | | | |
|---|---|---|---|
| 69,799 | 10/1867 | Greene | 297/145 X |
| 2,330,627 | 9/1943 | Reynolds | 297/145 |
| 2,845,113 | 7/1958 | Keel | 297/145 |
| 3,583,760 | 6/1971 | McGregor | 297/145 |

FOREIGN PATENT DOCUMENTS

| | | | |
|---|---|---|---|
| 1174692 | 3/1959 | France | 297/145 |
| 667894 | 3/1952 | United Kingdom | 297/145 |

*Primary Examiner*—Peter R. Brown
*Attorney, Agent, or Firm*—Stephen D. Carver

[57] ABSTRACT

An auxiliary furniture tray system for hidden installation in conventional furniture can be quickly moved between a hidden, rest position and an adjustable, deployable orientation. The system is mounted within the arm or arm rest. The frame comprises a pair of spaced apart, rectangular sidewalls secured together by an upper corner strut and a lower, spaced apart pivot strut extending between the top, inside of the frame. A lower, transverse mounting strut is fastened to interior portions of the furniture frame. A rigid tray slidably associated with the frame is displaceable between a vertically oriented rest position, and a substantially withdrawn horizontally oriented service position. Pairs of guide tracks attached to the opposite sidewalls define a slot for guiding and aligning the tray during vertical movements. Vertical tray travel is limited by a stop block system, and when the tray is pulled vertically, it reaches an upper limit established by the stop blocks, whereupon it may be pivotally deployed to the horizontal service position, resting partially upon the pivot strut at the top of the frame with its captured end wedged into the underside of the corner strut. The yieldably captivated end of the tray mates with the corner strut, and it includes pins which mesh with a groove in the corner strut, enabling the tray to slide forward and backward relative to the user. When the tray is appropriately angularly adjusted, it can be easily removed.

5 Claims, 5 Drawing Sheets

AUXILIARY FURNITURE TRAY SYSTEM

CROSS REFERENCE TO RELATED APPLICATION

This application is a continuation in part of our pending application, Ser. No. 07/426,014, filed Oct. 24, 1989, now abandoned, entitled Folding Concealable Furniture Tray System.

BACKGROUND OF THE INVENTION

The present invention relates generally to accessory trays for furniture. More particularly, the present invention relates to concealed trays of the type adapted to be mounted within the arm rest associated with furniture items including chairs, love seats, couchs, sofas or the like.

In the prior art it is known to associate various forms of extensible, foldable tray systems with furniture. In the airline industry, for example, various types of folding trays associated with passenger seats may be selectively deployed to provide a temporary table for a meal. Suitable clips may be manipulated to deploy the tray, which folds down with suitable levers into a generally horizontal position. Trays may also be disposed within the arm rest of a chair, as seen in U.S. Pat. No. 4,668,010 issued May 26, 1987.

U.S. Pat. No. 4,834,449 issued May 30, 1989 discloses a collapsible table assembly which may be hidden within the arm of a chair or couch. A carriage is slidably fitted into the arm, for selective movement outwardly of the chair or couch, and then an associated tray may be swung into position. Unfortunately devices which pull outwardly from chairs can interfere with the feet of the user. Other disadvantages exist. For example, they can obstruct passage in crowded living rooms. Moreover it has been our experience that systems of this nature are more difficult to install, and hence are relatively uncompetitive.

Dykstra U.S. Pat. No. 4,818,017 issued Apr. 4, 1989 and U.S. Pat. No. 4,756,572 issued July 12, 1988 disclose foldable beverage holders for use in vehicles. An auxiliary, detachable serving tray for use with furniture is seen in U.S. Pat. No. 4,575,149. That tray is temporarily clamped to the furniture when used.

A collapsible end table is seen in U.S. Pat. No. 4,508,038 issued Apr. 2, 1985. This device can be folded into a relatively narrow configuration for subsequent storage adjacent a couch, chair or other article of furniture. When it is desired to deploy the apparatus, an associated table can be unfolded, and the unit can function as an end table or coffee table etc. However, it has been our experience with accessory tables of this nature that they tend to get in the way, and they tend to detract from the ornamental appearance of the furniture with which they are used.

An externally visible folding tray is seen in the wheel chair invention of U.S. Pat. No. 4,428,616. A beverage cup holder is seen in U.S. Pat. No. 4,262,962. U.S. Pat. No. 4,372,604 issued Feb. 8, 1983 discloses an arm rest table assembly. Ideally the invention is employed with railway passenger car compartments. This patent discloses a table assembly which can be folded from an upright position to a horizontal deployed position. Other prior art relating to the aforesaid concept is also referenced in the latter patent.

U.S. Pat. No. 3,675,968 issued July 11, 1972 discloses a tablet arm assembly for seats. This device includes a table member of generally planar dimensions, which can be folded into an upward vertical position, a generally horizontal position for writing, and a lower storage position. However the table member is disposed entirely externally of the apparatus. When not in use it remains clearly visible, and while its utilitarian attributes may be desirable, its less-than-appealing ornamental appearance denigrates its value as decorative living room furniture.

U.S. Pat. No. 69,799 issued Oct. 15, 1867 discloses a collapsible table assembly for sewing tables and other articles of furniture. Unfortunately the handle on this system is designed in such a way as to allow the user to smash there fingers when stowing away. Other disadvantages also exist. For example, if this system was installed in a sofa, chair, or the like, it could not be adjusted to fit various sized users.

British patent 667,894 issued Mar. 12, 1952 discloses a tray system that deploys to the outside of the chair arm. Unfortunately this makes it very inconvenient to the user. It makes it unreadily accessible and awkward to reach over the arm to the other side to access food, beverages, writing material.

French patent 1,174,692 issued Mar. 13 1959 and U.S. Pat. No. 2,330,627 issued Sept. 28, 1943 disclose tray systems for chairs. The latter systems are believed awkward and difficult to use. Inconvenience to the user is aggravated by the difficulty in reaching over the arm of the chair.

U.S. Pat. No. 2,845,113 issued July 29, 1958 discloses a tray system in the arm of a chair. This system appears to be unstable. When tray is deployed in a horizontal position, all of the support relys on one attach point for all its stability. When being used it appears the system would rock and slide around freely, since there are no stopping points on the system.

We have determined that it is extremely desirable to provide a tray which may be fixedly associated with upholstered furniture. While tray systems are known for rigid educational desks, aircraft seats and the like, known devices are not concealable. Hence folding tray systems which are exposed to view even when in the storage position have not been successful when employed with upholstered furniture used in offices, living rooms, family rooms or the like. A completely concealable folding tray system which may be readily deployed in conventional upholstered furniture is thus desirable. Our experiments and tests reveal that by properly concealing a folding tray system within the arm rest or arms associated with a chair or love seat, the otherwise ornamentally detrimental appearance of folding linkage systems is obviated. A normally hidden tray having a suitable service side potentially available for supporting dishes or a snack would be regarded by purchasers of fine furniture as a step forward rather than a step backwards, particularly where the tray system may be deployed without interfering with the feet of the user, and without impeding passage through the room.

SUMMARY OF THE INVENTION

Our invention comprises a hidden furniture tray system for installation in conventional fine furniture. The system is preferably mounted within the arm rest of overstuffed chairs, upholstered couches or similar articles of furniture during manufacture. It provides a normally concealed service shelf which can be deployed as needed by the user into a variety of useful positions.

The system comprises a rigid frame which is adapted to be operatively vertically mounted within the arm rest at a desired side of the chair, love seat or couch. The frame is somewhat box-like in appearance, comprising a pair of spaced apart sidewalls secured together by suitable struts. The sidewalls are generally rectangular, and they are substantial mirror images of one another. One sidewall has a cutout to facilitate adjustment of the table to a desired position by the user.

A corner strut extends between the sidewalls at their upper outer corners. A pivot strut extends between the top of the sidewalls on the inside of the frame, spaced apart from and beneath the corner strut. Both of the struts extend transversely across the top regions of the frame sidewalls, to secure the frame sidewalls together and to define a tray discharge slot therebetween. A lower transverse mounting strut extending between the sidewall bottoms may be fastened to interior portions of the furniture item's frame to securely install the instant system. The lower mounting strut braces the system' frame, and enables it to be firmly mounted to suitable cross pieces in the framework of the article of furniture in which the tray is installed.

A rigid tray is slidably associated with the frame, and is yieldably captivated therein. The frame sidewalls are provided with tray aligning tracks defining a guide slot which confines vertical movements of the tray. Normally the tray may be housed within the frame, positioned substantially vertically within the discharge slot beneath the corner strut. The tray may be lifted manually upwardly, and its free end may be pulled vertically upwardly through the discharge slot. A stop block system prevents inadvertent tray withdrawal when pulled vertically upwardly too far. Subsequent pivotal maneuvering of the tray into a horizontal position deploys the tray for service.

When the tray is pulled upwardly, it reaches an upper limit first established by the stop block system, at which point it may be pivoted horizontally. When it is so deployed it rests partially upon the pivot strut at the top of the frame, and its captivated end is wedged into the underside of the corner strut. The corner strut includes a groove which, when the tray is folded horizontally, is penetrated by suitable follower pins projecting from the tray captivated end. Further horizontal movement of the tray in directions to the left or the right of the user is prevented by the pins meshed within the groove. However, a sliding movement is facilitated toward or away from the user.

The corner strut preferably comprises a rigid interior brace of L-shaped cross section. Preferably it mates with the captivated end of the tray. In this manner the tray is firmly held in a horizontal position when so deployed, since when the tray is released it pivots over the pivot strut and works as a lever to engage the underside of the corner strut. In this region where pivoting induced force is distributed, the captured end of the tray and the L-shaped corner strut firmly supports the tray.

Then, when the tray is to be reinserted into the frame after being used, it cannot be axially over-extended since the corner strut firmly limits axial displacement. Hence it will easily fold over into a position established by the guide blocks, for captivation within the frame in a position hidden from the owner of the furniture.

By suitably maneuvering the try to an angular withdrawal position, it may be completely removed from the frame. Thus the tray may be easily cleaned apart from the furniture.

Thus a basic object of the present invention is to provide a furniture tray system which can be easily and conveniently deployed by mere lifting and folding, while only minimally obstructing the furniture unit in which it has been installed.

A similar basic object of the present invention is to provide a hidden tray system which may be selectively deployed when desired by the user and folded away into a convenient non visible position.

Another object of the present invention is to provide a tray system of the character described ideally suited for use with conventional love seats, overstuffed chairs, sofas, couches, and other articles of fine furniture.

A still further object of the present invention is to provide a tray system of the character described with a movable tray which may be folded into a variety of positions, which reliably stays in the service position when so deployed, and which may conveniently removed from the apparatus without tools when desired.

More specifically, a primary object of the present invention is to provide a tray for use in systems of the character described which can be firmly maintained in a stable position when deployed horizontally, and which can be adjusted to desired position for various sized people.

Another object is to provide a yieldably captivated tray which is highly stable when deployed in its service position. A feature of the present invention that the captivated end of the tray firmly mates with the corner strut associated with the frame, and the more pressure that is placed upon the tray, the more firmly the corner strut and the tray captivated end mesh.

Another important object is to provide a tray system which, when deployed, does not block one's knees or feet.

A related object is to provide a tray system of the character described which is convenient for use with furniture when arranged in an L-shaped configuration.

Yet another object of the present invention is to provide a tray system of the character described which may be installed as original equipment in new furniture.

A still further object of the present invention is to provide a furniture tray system which is ornamentally pleasing to the user and which presents only a minimum of disturbance to the appearance of the furniture when deployed in a storage position.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
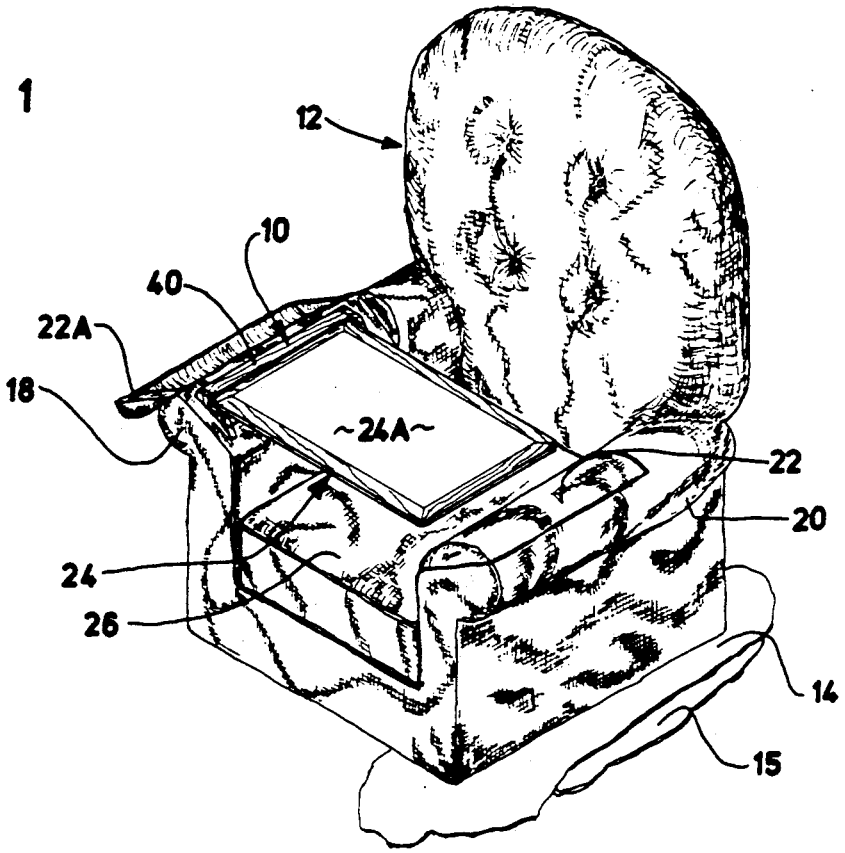
FIG. 1 is a fragmentary pictorial view of a typical item of furniture on which our Auxiliary Furniture Tray System has been mounted, with the tray deployed for use.

With reference now to the appended drawings, our Auxiliary Furniture Tray System has been generally designated by the reference numeral 10. Tray system 10 is shown mounted on a conventional overstuffed chair 12 conveniently disposed on a rug 14 overlying a traditional floor 15. The conventional chair 12 is illustrative only, and it should be appreciated that system 10 may be adequately employed in conjunction with articles of furniture such as sofas, couches, love seats and a variety of overstuffed and upholstered and wooden furniture items, all of which are collectively referred to herein as "furniture."

System 10 may be deployed in conjunction with either the left or right arm rest of the furniture item. System 10 is deployed in the user's right (as viewed in FIG. 1) arm rest 18 but it may be employed in the opposite arm rest 20. Chair 12 includes conventional foldable arm rest covers 22, 22A which normally cover the arm rest. Either may be folded away, as is arm rest cover 22A in FIG. 1. Cover 22A on arm rest 18 covers the visible portions of the tray system 10 as will hereinafter be explained.

Figure 2:
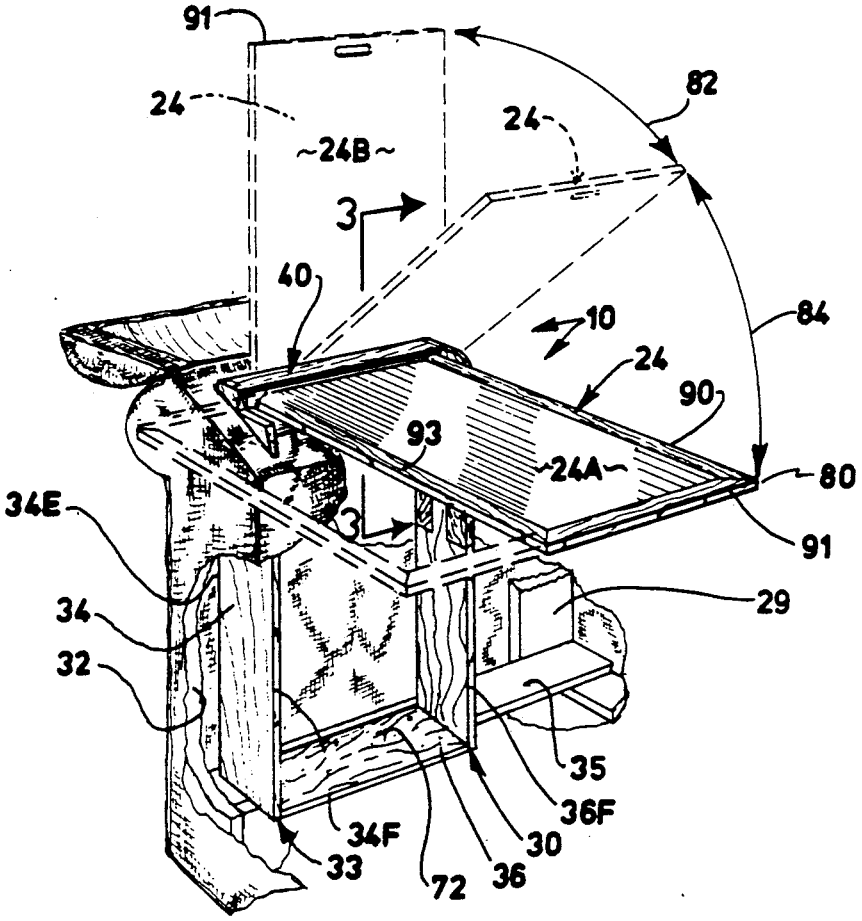
FIG. 2 is an enlarged, fragmentary, perspective view of the system disposed in a deployed position, with dashed lines indicating alternative tray positions.

When deployed as illustrated, tray 24 will be disposed generally horizontally above the seat cushion 26, conveniently disposed in front of the innermost sidewall 36 of the frame 30 (FIG. 2) in easy reach of a seated user (not shown) The service side 24A of the tray may support a variety of items such as newspapers, plates, glasses, silverware etc. Tray 24 also comprises an underside 24B (FIG. 2). Note that no projections extend forwardly of the chair 12 when the tray is horizontally deployed.

With additional reference now to FIGS. 2 through 6, the folding tray system 10 preferably comprises a frame generally designated by the reference numeral 30, which may be generally vertically mounted and secured within an interior cavity 32 (FIG. 2) of the furniture arm rest 18. Normally a plurality of internal braces such as side brace 29 and strut 35 (FIG. 2) are associated with the conventional internal skeleton of the chair 12. Frame 30 should be secured to at least a portion of the internal chair framework once it is fitted within cavity 32 defined in the top of the arm rest 18.

Figure 5:
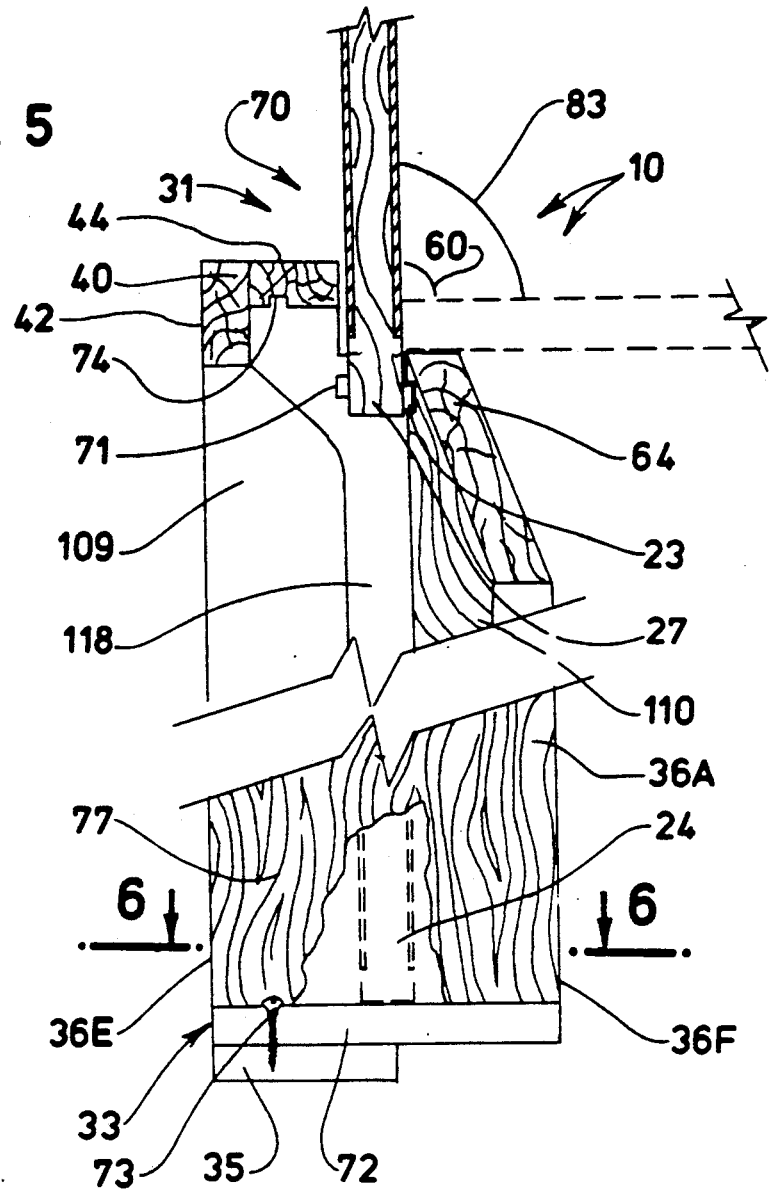
FIG. 5 is an enlarged fragmentary sectional view similar to FIG. 4 illustrating alternative tray positions.

Frame 30 comprises a top, generally designated by the reference numeral 31, which is spaced apart from the frame bottom generally designated by the reference numeral 33. Frame 30 preferably comprises a pair of generally vertically upright, rigid sidewalls 34 and 36, which are spaced apart in generally parallel relation. Sidewalls 34 and 36 are virtual mirror images of one another. However, a clearance cut out 11 on either sidewall 34 or 36 is provided by cutting a notch 11B to be adjusted to desired distance from the user, and which comprise a mirror image of one another, are both generally rectangular, and preferably made out of wood. Each sidewall has an inner surface such as surface 36A (FIG. 5) which faces the interior 35 of the frame. The top and bottoms of the sidewalls correspond to the top and bottom of the frame. Sidewalls 34, 36 include outside edges such as outside edge 34E (FIG. 2) and inside edges 34F, 36F (FIGS. 2, 5).

The frame preferably includes an elongated corner strut 40 which is preferably joined to the outside edges of sidewalls 34 and 36. As viewed in FIG. 5, this corner strut 40 may be formed from a generally planar rectangular board 42 which intersects a corner brace 44, forming a generally L-shaped cross section.

Figure 4A:
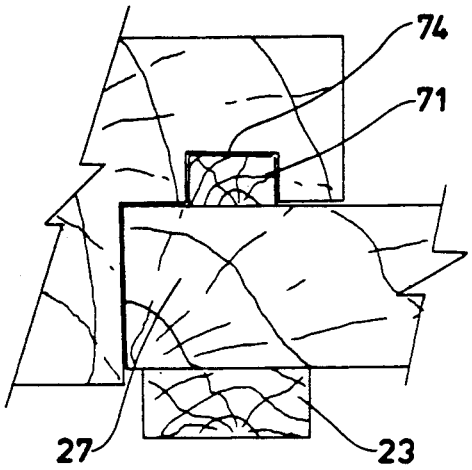
FIG. 4A is a greatly enlarged, fragmentary sectional view illustrating interior contact of the tray captivated end with the frame corner strut.
Figure 4:
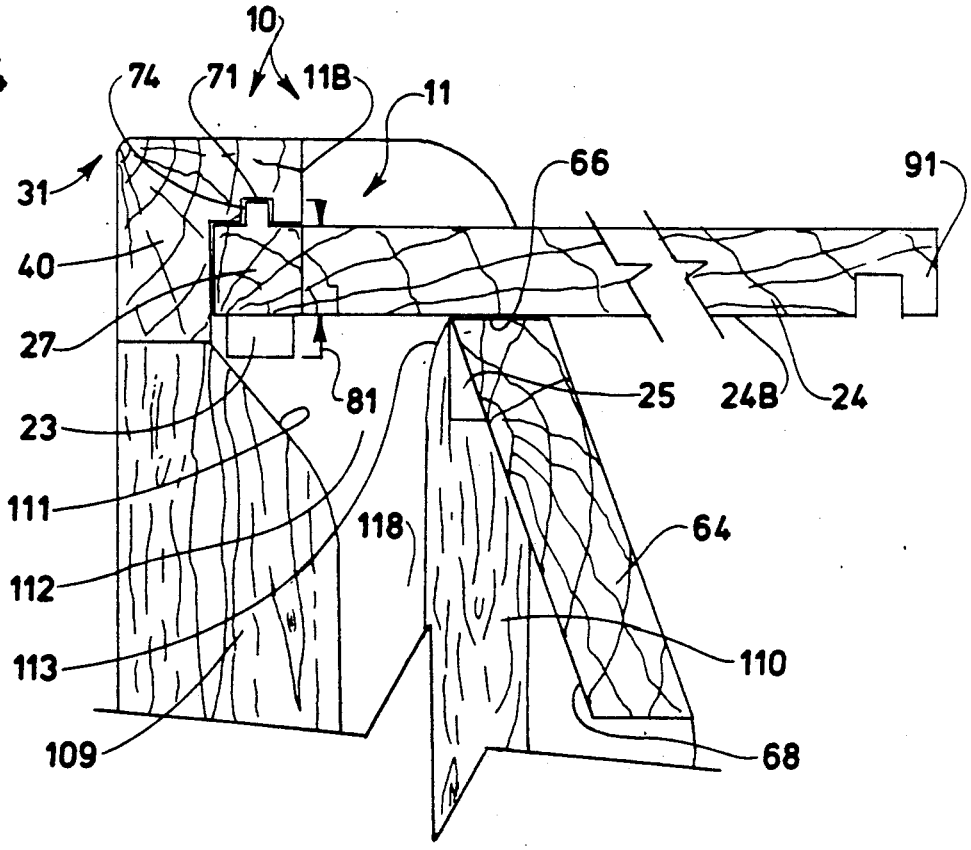
FIG. 4 an enlarged, fragmentary sectional view similar to that of FIG. 3, but illustrating the captivated end of the tray in more detail.

As best viewed in FIGS. 4 and 4A, the preferred corner strut 40 projects toward the interior 35 of the frame 30. When tray 24 is pulled upwardly, stop block 23 mounted on the underside of tray bottom 27 mates with an elongated stop 25 centered upon the upper surface of the pivot strut 66. When tray 24 is deployed in the horizontally oriented service position of FIGS. 1 and 4, its yieldably captivated end 27 will generally wedge against and abut the underside 53 of corner brace 40.

Pivot strut 64 is preferably wooden, and it includes an upper flat surface 66 upon which tray 24 will partially rest when the tray is disposed horizontally. Edge 68 faces into the interior 35 of the frame. Pivot strut 64 extends across the frame between its opposite sidewalls 34 and 36, and it is secured to the sidewalls just below the tops thereof, and at an elevation spaced apart from and below corner strut 40. When the tray 24 is disposed horizontally, its underside 24B will rest upon surface 66 of pivot strut 64, and the captivated end 27 of the tray will be wedged into contact with the corner strut assembly previously discussed.

In the best mode the frame assembly will also comprise a lower transverse mounting strut 72 which extends across the frame bottom and is attached to each sidewall 34 and 36. Conventional wood screws such as screw 73 (FIG. 5) may be employed to firmly mount the frame to the original equipment frame members 34 (FIG. 2).

Tray 24 is preferably made of wood. Its captivated end 27 cannot normally escape from the frame interior, unless the tray is oriented as hereinafter described. The remote free end, generally designated by the reference numeral 80, is free to escape the frame, and pivot between the positions indicated by arrows 82, 84 of FIG. 2 and/or arrow 83 of FIG. 5. The tray 24 includes an inner planar wooden core 86 framed between suitable edge bandings 90–93 (FIG. 4) which are preferably formed from one-inch hardwood molding. The edge bandings surround the captivated inner piece 86, whose surfaces are preferably covered with suitable laminate to form the service side 24A (FIG. 1) and the underside 24B (FIG. 2) of the tray.

When so deployed, axial movement of the tray will be prevented because vertical portion 70 of the tray system will abut the similarly positioned adjacent vertical portion, corner strut 40. And, it will be apparent that since the tray will rest against the pivot brace 64 (FIG. 4) a pivot is thereby established, so that as the tray is loaded the horizontal portion 70 of the tray 24 will be forced up against the underside of corner brace 40. In other words pivoting is limited. However besides the limiting effects of pivoting established by the interlocking braces of FIG. 4A, follower pins 71 also interlock in tracking groove 74 which limits deflection.

Importantly a clearance distance is preserved. The combined length of the pins, the width of the tray, and the thickness of the stop block 23, indicated in FIG. 4 by the reference numeral 81, comprises a clearance distance facilitating disconnection of the tray from the system. Clearance distance 81 is less than the escape distance 85 (FIG. 8) between those corners of the pivot strut and the cross strut immediately adjacent to the discharge slot.

Figure 8:
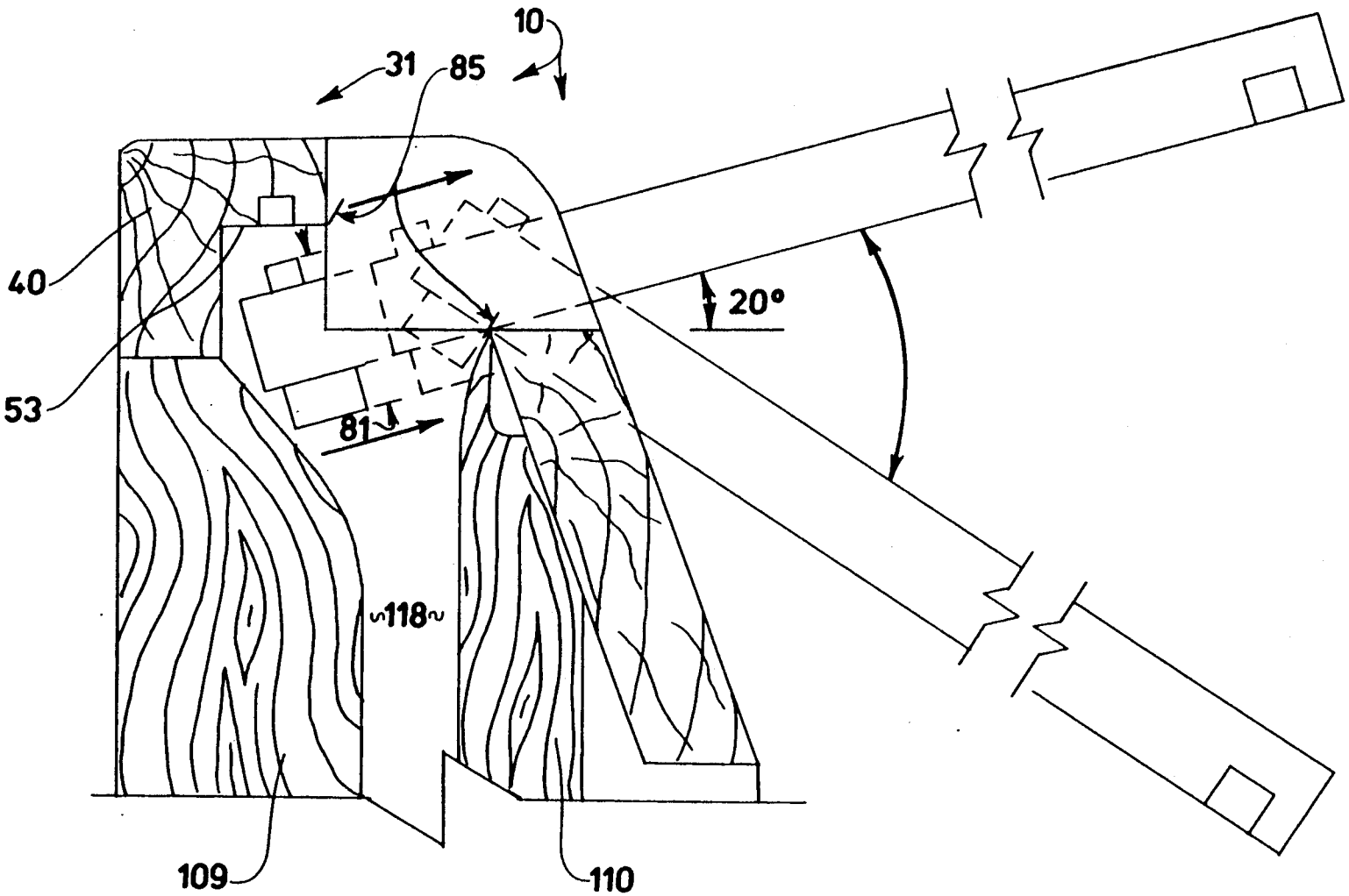

Thus, as seen best in FIG. 8, the tray can be withdrawn from the frame means, by carefully pivoting it to an angle of approximately twenty degrees. When so disposed, it can be gently displaced manually between the discharge slot. Removal facilitates cleaning and maintenance.

Figure 6:
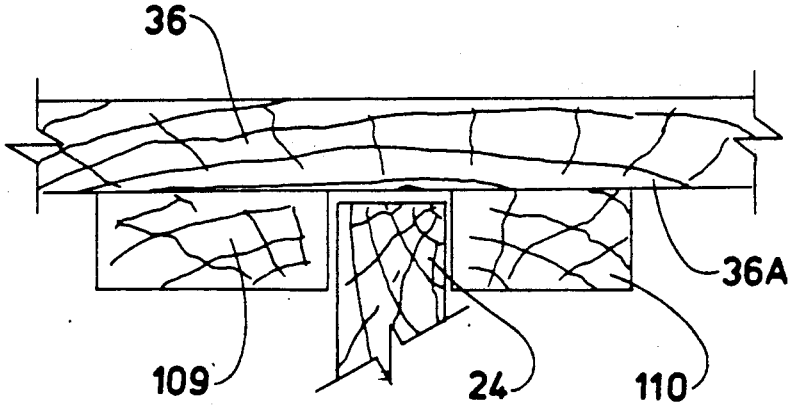
FIG. 6 is an enlarged, fragmentary sectional view taken generally along line 6—6 of FIG. 5.
Figure 7:
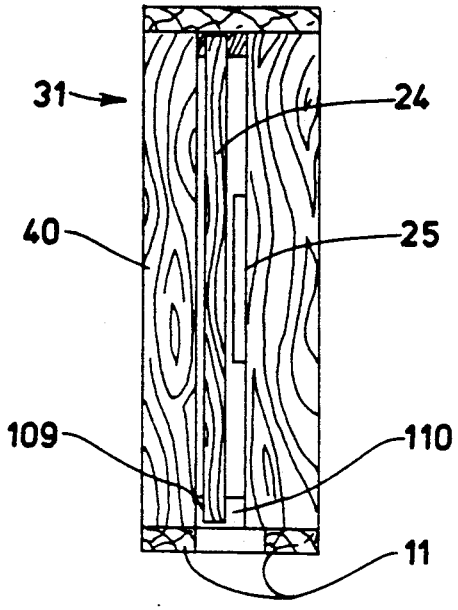
FIG. 7 is an enlarged, fragmentary top plan view of the system taken from a position above FIG. 5.
Figure 7B:
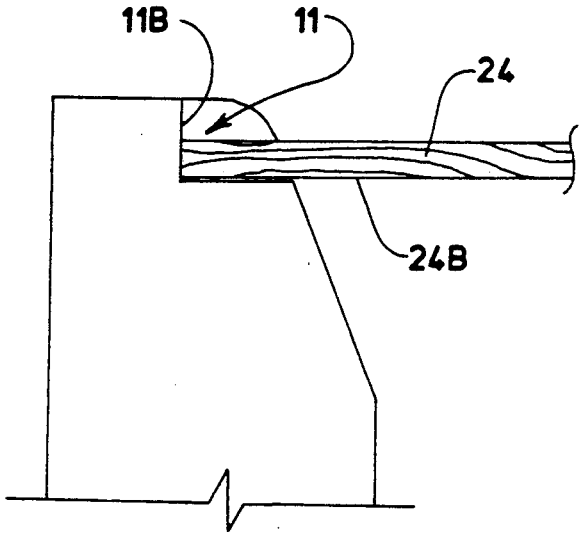
FIG. 7B is an enlarged, fragmentary sectional view showing the cut out in one sidewall enabling the tray to be slid within a plane normal to the frame means; and, FIG. 8 is a greatly enlarged, fragmentary sectional view illustrating tray movement and withdrawal.
Figure 7A:
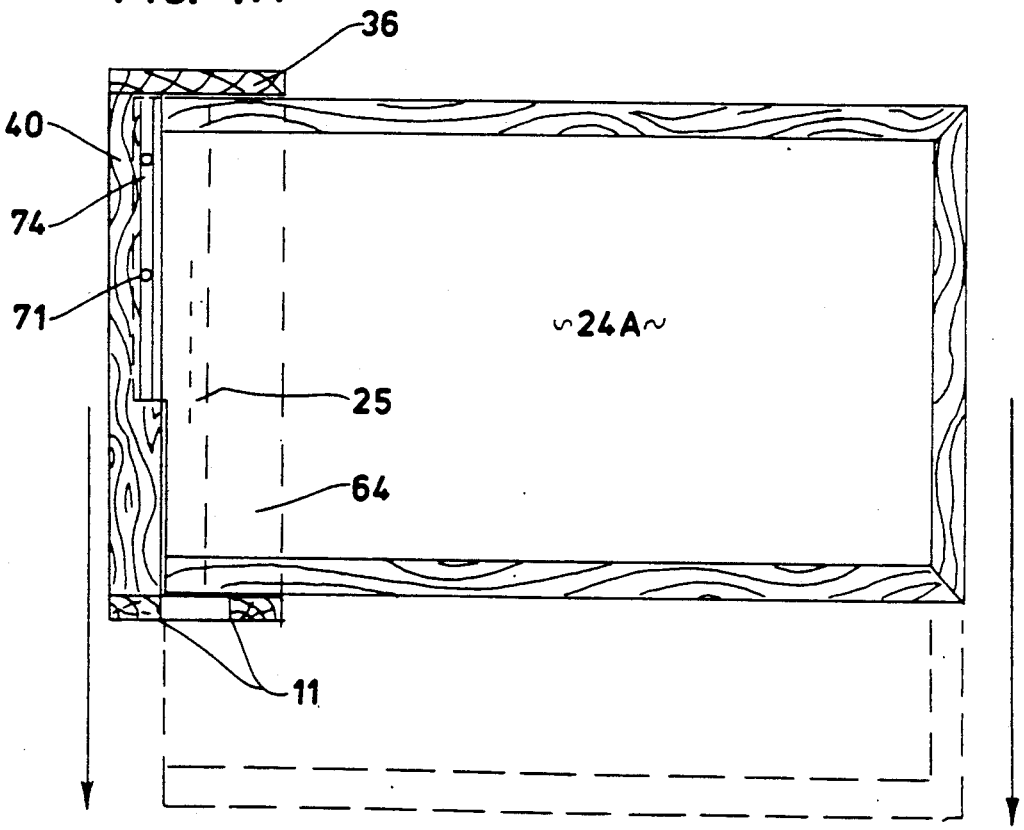
FIG. 7A is an enlarged, fragmentary plan view of the system taken from a position above FIG. 4.

Each pair of guide tracks (FIG. 6) include individual parallel and spaced apart tracks 109 and 110. Track 109 has an upper, arcuate region 111 adjacent to the throat 112 formed between track 109 and the curved upper portion 113 of spaced apart track 110. Tray 24 slides between guide tracks 109 and 110 which are mounted on the inner frame sidewalls. For example as best seen in FIG. 6, the guide tracks 109 and 110 are mounted on inner surface 36A of frame sidewall 36.

It will be apparent that the discharge slot 60 which is essentially formed between pivot strut 64 and the corner brace 40 are aligned with the slots 118 so as to firmly maintain the tray 24 in the centered position illustrated in FIG. 5. Thus when the tray is moved inwardly or outwardly of the frame interior 35 through the discharge slot 60, it will be appropriately centered between pivot strut 64 and corner strut 40 as illustrated best in FIG. 5. When dropped all the way to the bottom of the frame, the tray edge 70 will preferably contact the resilient cross piece 77 to firmly limit downward displacement.

OPERATION

Figure 3:
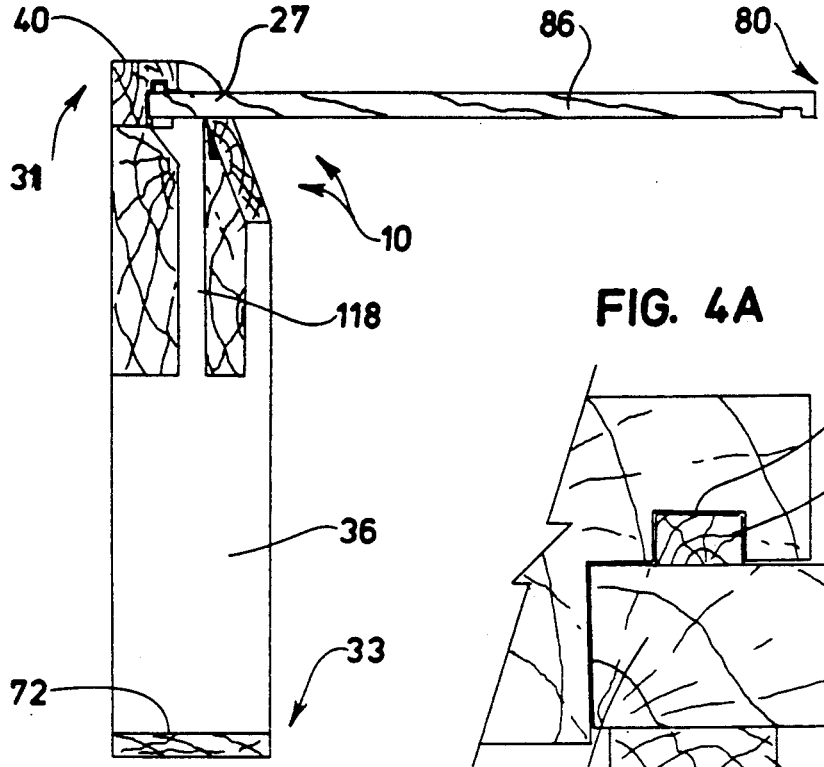
FIG. 3 is an enlarged, fragmentary, sectional view taken generally along line 3—3 of FIG. 2, with portions thereof broken away or omitted for clarity.

Once installed appropriately within the chair 12 the tray system may be employed in a desired position simply by lifting up vertically, and then by pivoting. When the tray is to be moved, it is preferred that a recessed handle 119 defined in the underside 24B at the remote tray end 80 be manipulated to move the tray upwardly and outwardly. When the tray 24 is dropped all the way into the frame, tray bottom 27 contacts the transverse mounting strut 72 (FIGS. 3,5). Handle 119 will be positioned immediately above pivot brace 64 within the tray discharge slot 60. In this manner fingers will not be injured as the tray moves through its positions. Of course when the tray 24 is disposed within the frame, the visible portions of the system such as corner strut 40 may be completely hidden by an arm rest covering such as covering 22.

When it is desired to deploy the tray, one need merely tilt the covering 22A and grasp handle 119. The tray 24 may then be lifted out of the frame by pulling it upwardly until the stop block 23 contacts with stop 25 within the tops of grooves 118. When contact is made the tray may merely be pivoted as indicated by arrows 82, 84 (FIG. 2) and its captivated inner end 70 will be restrained against the corner strut 40 as previously described. It may then be adjusted by merely pushing with the hand of the user to get the desired position on the tray. It may then be pulled back to original deployed position and lifted up to deploy inside the arm.

As seen in FIG. 8, tray 24 can easily be removed by grasping handle 119 and lifting upward to a 20 degree angle. The tray 24 may then be pulled forward until stop block 23 hits stop 25. User must then let tray 24 tilt downward until tray is free. Tray 24 can then be easily cleaned and installed back in tray system 10.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An auxiliary furniture tray system for chairs, love seats, sofas, or other articles of furniture, said tray system comprising:

frame means for mounting said system within an article of furniture, said frame means comprising:

a pair of rigid, spaced apart sidewalls, each sidewall having a bottom, a top, and inside and outside edges;

a corner strut extending between said sidewalls at the top outside edges thereof; and, a pivot strut extending between the top inside edges of said sidewalls beneath said corner strut;

a tray discharge slot defined between said corner strut, said pivot strut, and said frame sidewalls;

a generally planar tray slidably disposed within said frame means and yieldably captivated therewithin, said tray adapted to be selectively displaced between a generally vertical rest position concealed within said frame means and a generally horizontal service position extending perpendicularly outwardly of said frame means through said tray discharge slot, said tray having a free end adapted to be grasped by a user, and a yieldably captivated end normally disposed within said frame means;

means associated with said captivated tray end for temporarily mating with said corner strut when said tray is deployed in said service position, said last mentioned means permitting relative slidable displacement between said tray and said frame means, whereby when said tray is disposed horizontally, said tray may be slidably adjusted toward or away from said user; and, guide track means associated with each sidewall forming a tray receptive guide slot in alignment with said tray discharge slot for controlling said tray within said frame means.

2. The tray system as defined in claim 1 wherein said system comprises stop means disposed between said sidewalls for limiting vertical movement of said tray from said discharge slot, and said tray comprises stop block means associated with said captivated end for contacting said stop means when withdrawn vertically to a distance appropriate for subsequent pivoting into said horizontal service position.

3. The tray system as defined in claim 2 wherein said means associated with said captivated tray end for temporarily mating with said corner strut when said tray is deployed in said service position comprises follower pin means projecting outwardly from said tray captivated end and groove means defined within said corner strut for slidably receiving said follower pin means.

4. The tray system as defined in claim 3 wherein said tray may be easily removed from said frame means by:

slightly angling said tray;

then pulling said tray until said stop block contacts said stop means; and, then tilting said tray downwardly until said tray is free from said discharge slot.

5. The tray system as defined in claim 1 wherein:

the tray comprises a clearance distance equal to the length of said pins, plus the width of said tray, plus the thickness of said stopblock means;

an escape distance is defined within said discharge slot between said corner strut and said pivot strut; and, said clearance distance is slightly less than said escape distance wherein said tray may escape from said frame means when appropriately pivoted and displaced.

* * * * *